US008752834B2

(12) United States Patent
Otsuki et al.

(10) Patent No.: US 8,752,834 B2
(45) Date of Patent: Jun. 17, 2014

(54) IMAGE FORMING APPARATUS

(75) Inventors: Naohito Otsuki, Kanagawa (JP); Yoshinori Koike, Kanagawa (JP); Shouichi Maeda, Kanagawa (JP); Junichi Asaoka, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 251 days.

(21) Appl. No.: 13/152,791

(22) Filed: Jun. 3, 2011

(65) Prior Publication Data

US 2012/0112400 A1 May 10, 2012

(30) Foreign Application Priority Data

Nov. 9, 2010 (JP) ..... 2010-250729

(51) Int. Cl.
*B65H 5/34* (2006.01)

(52) U.S. Cl.
USPC ..... 271/270; 271/265.01

(58) Field of Classification Search
USPC ..... 271/225, 270, 265.01
See application file for complete search history.

(56) References Cited

U.S. PATENT DOCUMENTS

| | | | | |
|---|---|---|---|---|
| 5,622,365 | A * | 4/1997 | Ito | 271/264 |
| 6,201,946 | B1 | 3/2001 | Takeuchi et al. | |
| 6,512,914 | B2 * | 1/2003 | Kabashima | 399/341 |
| 2002/0191992 | A1 * | 12/2002 | Funato | 399/320 |
| 2005/0251286 | A1 * | 11/2005 | Yasui | 700/230 |

FOREIGN PATENT DOCUMENTS

JP 2004-163926 A 6/2004

* cited by examiner

*Primary Examiner* — Michael McCullough
*Assistant Examiner* — Howard Sanders
(74) *Attorney, Agent, or Firm* — Sughrue Mion, PLLC

(57) ABSTRACT

An image forming apparatus includes a fixing device including a pair of first rotating members; a first transport path having a curved portion where a recording medium is curved, the first transport path being for transporting the recording medium to which the image is fixed by the pair of first rotating members; a first transporting section including a pair of second rotating members provided downstream from the curved portion of the first transport path; and a controller that controls so that, while the recording medium is interposed between the pair of first rotating members and the pair of second rotating members, a peripheral velocity of the second rotating members and a peripheral velocity of the first rotating members are reduced at the same time, or the peripheral velocity of the second rotating members is reduced before reducing the peripheral velocity of the first rotating members.

16 Claims, 10 Drawing Sheets

IMAGE FORMING APPARATUS

CROSS-REFERENCE TO RELATED APPLICATIONS

This application is based on and claims priority under 35 USC 119 from Japanese Patent Application No. 2010-250729 filed Nov. 9, 2010.

BACKGROUND

(i) Technical Field

The present invention relates to an image forming apparatus.

SUMMARY

According to an aspect of the invention, there is provided an image forming apparatus including a fixing device including a pair of first rotating members, the fixing device fixing an image to a recording medium by interposing the recording medium on which the image is formed between the pair of first rotating members, a peripheral velocity of the pair of first rotating members being variable; a first transport path having a curved portion where the recording medium is curved, the first transport path being for transporting the recording medium to which the image is fixed by the pair of first rotating members; a first transporting section including a pair of second rotating members provided downstream from the curved portion of the first transport path, the first transporting section transporting the recording medium downstream by interposing the recording medium between the pair of second rotating members, a peripheral velocity of the pair of second rotating members being variable; and a controller that controls so that, while the recording medium is interposed between the pair of first rotating members and the pair of second rotating members, the peripheral velocity of the second rotating members and the peripheral velocity of the first rotating members are reduced at the same time, or the peripheral velocity of the second rotating members is reduced before reducing the peripheral velocity of the first rotating members.

BRIEF DESCRIPTION OF THE DRAWINGS

An exemplary embodiment of the present invention will be described in detail based on the following figures, wherein.

DETAILED DESCRIPTION

An image forming apparatus according to an exemplary embodiment of the present invention will be described.

Figure 1:
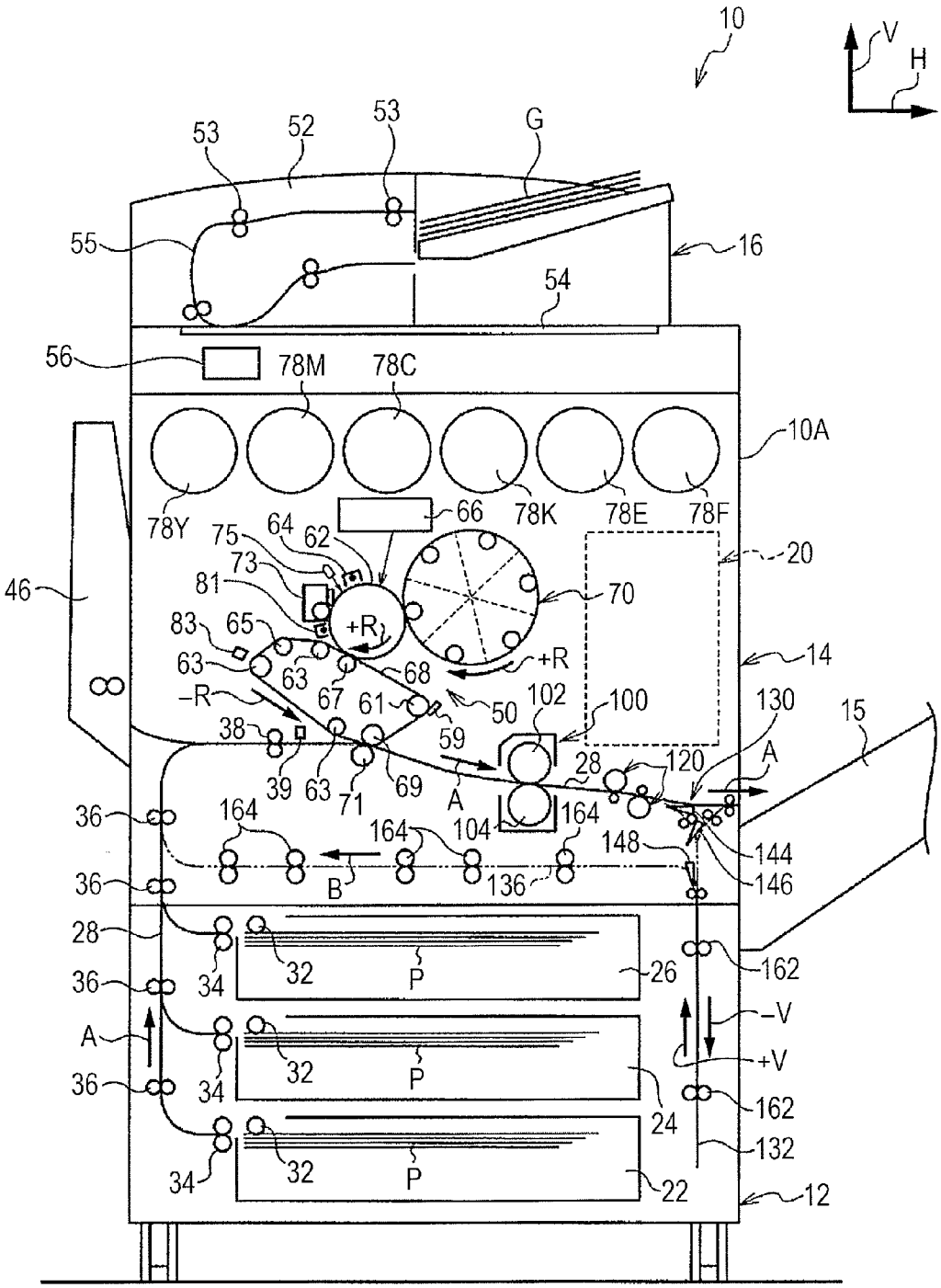
FIG. 1 shows the entire structure of an image forming apparatus according to an exemplary embodiment of the present invention.

FIG. 1 shows an image forming apparatus 10. The image forming apparatus 10 includes a sheet holding unit 12, a body 14, an original reading unit 16, and a controller 20, from a lower side to an upper side in a vertical direction (that is, in the direction of arrow V). The sheet holding unit 12 holds sheets of recording paper P serving as exemplary recording media. The body 14 is provided above the sheet holding unit 12, and performs image formation on the sheets of recording paper P supplied from the sheet holding unit 12. The original reading unit 16 is provided above the body, and reads reading originals G. The controller 20 is provided in the body 14, and serves as an exemplary controller that controls the operation of each portion of the image forming apparatus 10. In the description below, the vertical direction of an apparatus body 10A of the image forming apparatus 10 corresponds to the direction V, and the horizontal direction thereof corresponds to a direction H.

The sheet holding unit 12 includes a first holding section 22, a second holding section 24, and a third holding section 26, which hold sheets of recording paper P of different sizes. The first holding section 22, the second holding section 24, and the third holding section 26 are each provided with a sending roller 32 that sends the held sheets of recording paper P to a transport path 28 provided in the image forming apparatus 10. Pairs of transporting rollers 34 and pairs of transporting rollers 36 that transport the sheets of recording paper P one at a time are disposed downstream from the respective sending rollers 32 in the transport path 28. Adjustment rollers 38 are provided downstream from the transporting rollers 36 in a direction of transportation of the sheets of recording paper P in the transport path 28. The adjustment rollers 38 stop the sheets of recording paper P once, and send them to a second transfer position QB (described later; see FIG. 2) at a determined timing.

An upstream side portion of the transport path 28 is provided linearly from a lower left portion of the sheet holding unit 12 to a lower left portion of the body 14 in the direction V in front view of the image forming apparatus 10. A downstream side portion of the transport path 28 is provided from the lower left portion of the body 14 to a discharge unit 15 provided at the right surface of the body 14. A two-side transport path 136 is connected to the transport path 28, and allows the sheets of recording paper P to be transported and reversed for forming images on both surfaces of the sheets of recording paper P. A folding-type manual sheet feeding unit 46 is provided at the left surface of the body 14. A transport path of the sheets of recording paper P that are sent from the manual sheet feeding unit 46 is connected to a near side of the adjustment rollers 38 in the transport path 28. The switching between transport paths of the sheets of recording paper P will be described in detail below.

The original reading unit 16 includes a document transport device 52, a platen glass 54, and a document reading device 56. The document transport device 52 automatically transports the reading originals G one at a time. The platen glass 54 is disposed at the lower side of the document transport device 52. One reading original G is placed upon the platen glass 54. The document reading device 56 reads the reading original G transported by the document transport device 52 or the reading original G placed on the platen glass 54.

The document transport device 52 includes an automatic transport path 55 in which pairs of transporting rollers 53 are disposed. A portion of the automatic transport path 55 is disposed so that the reading original G passes the upper side of the platen glass 54. The document reading device 56 reads the reading original G transported by the document transport device 52 while it is stationary at a left end of the platen glass 54, or reads the reading original G placed on the platen glass 54 while it moves in the direction H.

The body 14 includes an image forming unit 50 serving as an exemplary image forming unit that forms a toner image (developer image) on the recording paper P. The image forming unit 50 includes a photoconductor member 62, a charging member 64, an exposure device 66, a developing device 70, an intermediate transfer belt 68, and a cleaning device 73 (described later).

The cylindrical photoconductor member 62, serving as an image carrying member, is provided at a central portion of the apparatus body 10A in the body 14. The photoconductor member 62 is rotated in a direction of arrow +R (clockwise in FIG. 2) by a driving unit (not shown), and carries at its outer peripheral surface an electrostatic latent image formed by light irradiation. The corotron charging member 64 that charges the surface of the photoconductor member 62 is provided above the photoconductor member 62 and opposes the outer peripheral surface of the photoconductor member 62.

The exposure device 66 is provided downstream from the charging member 64 in the direction of rotation of the photoconductor member 62, and opposes the outer peripheral surface of the photoconductor member 62. The exposure device 66 includes a semiconductor laser, a f–θ lens, a polygon mirror, an imaging lens, and mirrors (none of which are shown). On the basis of an image signal, laser light emitted from the semiconductor laser is deflected by the polygon mirror for performing scanning, and illuminates (is used for exposing) the outer peripheral surface of the photoconductor member 62 that is charged by the charging member 64, to form an electrostatic latent image. The exposure device 66 is not limited to a type in which the laser light is deflected by the polygon mirror for performing scanning. The exposure device 66 may be a type using a light emitting diode (LED).

The developing device 70 is provided downstream from a member that is irradiated with the exposure light of the exposure device 66 in the direction of rotation of the photoconductor member 62. The developing device 70 is a rotational switching type that develops the electrostatic latent image (formed on the outer peripheral surface of the photoconductor member 62) with toner of a determined color, to make visible the electrostatic latent image. Toner cartridges 78Y, 78M, 78C, 78K, 78E, and 78F are replaceably provided side by side in the direction H below the document reading device 56 and above the developing device 70. The toner cartridges 78Y, 78M, 78C, 78K, 78E, and 78F contain yellow (Y) toner, magenta (M) toner, cyan (C) toner, black (K) toner, a first special color (E) toner, and a second special color (F) toner, respectively. The first special color E and the second special color F are selected or are not selected from special colors (including transparent colors) which are not yellow, magenta, cyan, or black.

Figure 2:
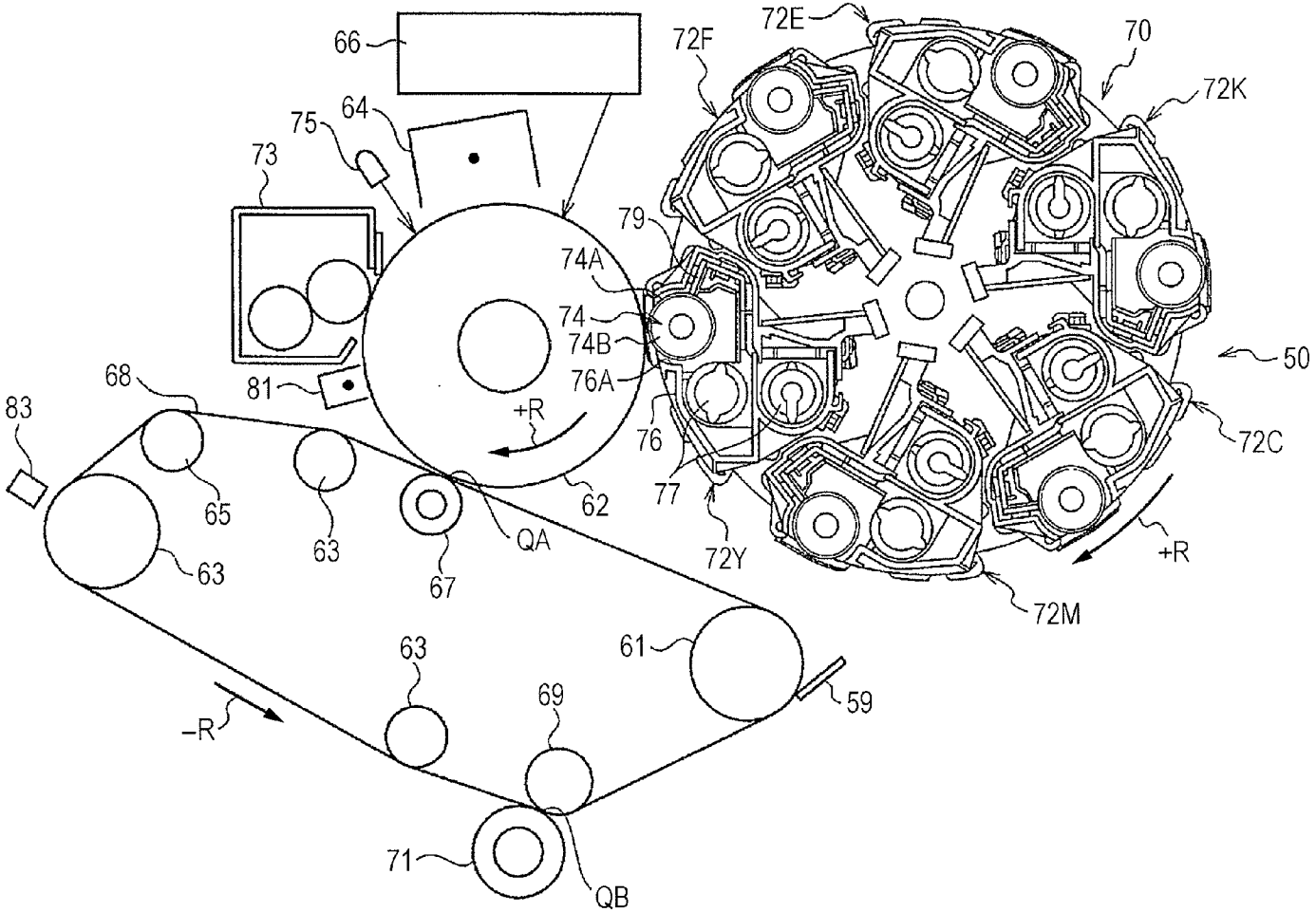
FIG. 2 shows the structure of an image forming unit according to the exemplary embodiment of the present invention.

As shown in FIG. 2, in the developing device 70, developing units 72Y, 72M, 72C, 72K, 72E, and 72F are disposed side by side in that order in a peripheral direction (that is, counterclockwise in FIG. 2) in correspondence with the toner colors, yellow (Y), magenta (M), cyan (C), black (K), the first special color (E), and the second special color (F). By rotating the developing device 70 by a motor (not shown) by a central angle of 60 degrees at a time, the developing unit 72Y, 72M, 72C, 72K, 72E, or 72F that performs a developing operation is switched, and the developing unit that is to perform the developing operation opposes the outer peripheral surface of the photoconductor member 62.

Since the developing units 72Y, 72M, 72C, 72K, 72E, and 72F have the same structures, here, the developing unit 72Y will be described, and the other developing units 72M, 72C, 72K, 72E, and 72F will not be described. When image formation using four colors, Y, M, C, and K, is performed, the developing units 72E and 72F are not used. Therefore, the angle of rotation from the developing unit 72K to the developing unit 72Y is 180 degrees.

The developing unit 72Y includes a case member 76 serving as a body. The case member 76 is filled with developer, formed of a carrier and toner, supplied from the toner cartridge 78Y (see FIG. 1) through a toner supply path (not shown). The case member 76 has a rectangular opening 76A opposing the outer peripheral surface of the photoconductor member 62. A development roller 74 whose outer peripheral surface opposes the outer peripheral surface of the photoconductor member 62 is provided in the opening 76A. Further, a plate-like regulating member 79 for regulating a layer thickness of the developer is provided near the opening 76A in the case member 76 so as to extend in a longitudinal direction of the opening 76A.

The development roller 74 has a rotatably provided cylindrical development sleeve 74A and a magnetic member 74B including magnetic poles fixed to the inner side of the development sleeve 74A. By rotating the development sleeve 74A, a magnetic brush of the developer (carrier) is formed. By regulating the layer thickness by the regulating member 79, a developer layer is formed on the outer peripheral surface of the development sleeve 74A. Then, the developer layer on the outer peripheral surface of the development sleeve 74A is transported to a position opposing the photoconductor member 62 by rotating the development sleeve 74A, so that toner that is in accordance with the latent image (electrostatic latent image) formed on the outer peripheral surface of the photoconductor member 62 adheres to the latent image, to develop the latent image.

In the case member 76, two spiral transporting rollers 77 are rotatably disposed beside each other. By rotating the two transporting rollers 77, the developer with which the case member 76 is filled is circulated and transported in an axial direction of the development roller 74 (that is, in a longitudinal direction of the developing unit 72Y). The six development rollers 74 of the developing units 72Y, 72M, 72C, 72K, 72E, and 72F are disposed in the peripheral direction with the size of the interval between adjacent development rollers 74 being equal to a central angle of 60 degrees. By switching a certain developing unit 72, the next developing roller 74 is made to oppose the outer peripheral surface of the photoconductor member 62.

As shown in FIG. 1, the intermediate transfer belt 68 is provided downstream from the developing device 70 in the direction of rotation of the photoconductor member 62, and is provided below the photoconductor member 62. Toner images that are formed on the outer peripheral surface of the photoconductor member 62 are transferred to the intermediate transfer belt 68. The intermediate transfer belt 68 is an endless belt, and is placed around a driving roller 61, a tension applying roller 65, transporting rollers 63, and an auxiliary roller 69. The driving roller 61 is rotationally driven by the controller 20. The tension applying roller 65 applies tension to the intermediate transfer belt 68. The transporting rollers 63 contact the inner side of the intermediate transfer belt 68, and are driven and rotated. The auxiliary roller 69 contacts the inner side of the intermediate transfer belt 68 at the second transfer position QB (described later; see FIG. 2), and is driven and rotated. By rotating the driving roller 61, the intermediate transfer belt 68 rotates in the direction of arrow −R (that is, counterclockwise in FIG. 2).

A first transfer roller 67 is provided opposite to the photoconductor member 62 with the intermediate transfer belt 68 being interposed therebetween. The first transfer roller 67 causes the toner images formed on the outer peripheral surface of the photoconductor member 62 to be transferred to the intermediate transfer belt 68 by a first transfer operation. The first transfer roller 67 is in contact with the inner side of the intermediate transfer belt 68 at a position where the photoconductor member 62 and the intermediate transfer belt 68 contact each other (this position is called "first transfer position QA" (see FIG. 2)). By applying electric power from a power source (not shown), the first transfer roller 67 causes the toner images carried by the outer peripheral surface of the photoconductor member 62 to be transferred to the intermediate transfer belt 68 by the first transfer operation as a result of a potential difference between the photoconductor member 62 that is connected to ground and the first transfer roller 67.

A second transfer roller 71 is provided opposite to the auxiliary roller 69 with the intermediate transfer belt 68 being disposed therebetween. The second transfer roller 71 causes the toner images transferred to the intermediate transfer belt 68 by the first transfer operation to be transferred to recording paper P by a second transfer operation. The position between the second transfer roller 71 and the auxiliary roller 69 corresponds to the second transfer position QB where the toner images are transferred to the recording paper P (see FIG. 2). The second transfer roller 71 is connected to ground, and is in contact with the surface (outer peripheral surface) of the intermediate transfer belt 68. By a potential difference between the second transfer roller 71 and the auxiliary roller 69 to which electric power is applied from a power source (not shown), the toner images on the intermediate transfer belt 68 are transferred to the recording paper P by the second transfer operation.

A cleaning blade 59 that collects residual toner after the second transfer operation at the intermediate transfer belt 68 is provided at a side opposite to the driving roller 61 with the intermediate transfer belt 68 being disposed therebetween. The cleaning blade 59 is mounted to a housing (not shown) having an opening. Any toner that is scraped off by an end of the cleaning blade 59 is collected in the housing.

A position detecting sensor 83 is provided at a position opposing the transporting roller 63 near the intermediate transfer belt 68. The position detecting sensor 83 detects a predetermined reference position on the intermediate transfer belt 68 by detecting a mark (not shown) on the outer surface of the intermediate transfer belt 68, and outputs a position detection signal serving as a reference of timing of starting the image formation. The position detecting sensor 83 detects a movement position of the intermediate transfer belt 68 by irradiating the intermediate transfer belt 68 with light and receiving the light reflected from the surface of the mark.

The cleaning device 73 is provided downstream from the first transfer roller 67 in the direction of rotation of the photoconductor member 62. The cleaning device 73 cleans off, for example, any residual toner that is not transferred by the first transfer operation to the intermediate transfer belt 68 and that remains on the surface of the photoconductor member 62. The cleaning device 73 collects, for example, any residual toner by a cleaning blade and a brush roller that are in contact with the outer peripheral surface of the photoconductor member 62.

A corotron 81 is provided upstream from the cleaning device 73 (that is, downstream from the first transfer roller 67) in the direction of rotation of the photoconductor member 62. The corotron 81 removes electricity of the residual toner remaining after the first transfer operation on the outer peripheral surface of the photoconductor member 62. An electricity removing device 75 that removes electricity by irradiating the outer peripheral surface of the cleaned photoconductor member 62 with light is provided downstream from the cleaning device 73 (upstream from the charging member 64) in the direction of rotation of the photoconductor member 62.

The second transfer position QB of the toner images defined by the second transfer roller 71 (see FIG. 2) is set in the transport path 28. A first sheet sensor 39 is provided between the second transfer position QB and the adjustment rollers 38 so as to be situated above the transport path 28 and near the adjustment rollers 38. The first sheet sensor 39 detects a front end position and a rear end position of recording paper P. For the first sheet sensor 39, for example, a reflecting optical sensor that irradiates the recording paper P with light and that receives the light reflected from the recording paper P may be used. A fixing device 100 is provided downstream from the second transfer roller 71 in the direction of transportation of the recording paper P (that is, in the direction of arrow A in FIG. 1) at the transport path 28. The fixing device 100 is an exemplary fixing device that fixes the toner images to the recording paper P to which the toner images have been transferred by the second transfer roller 71.

Figure 3:
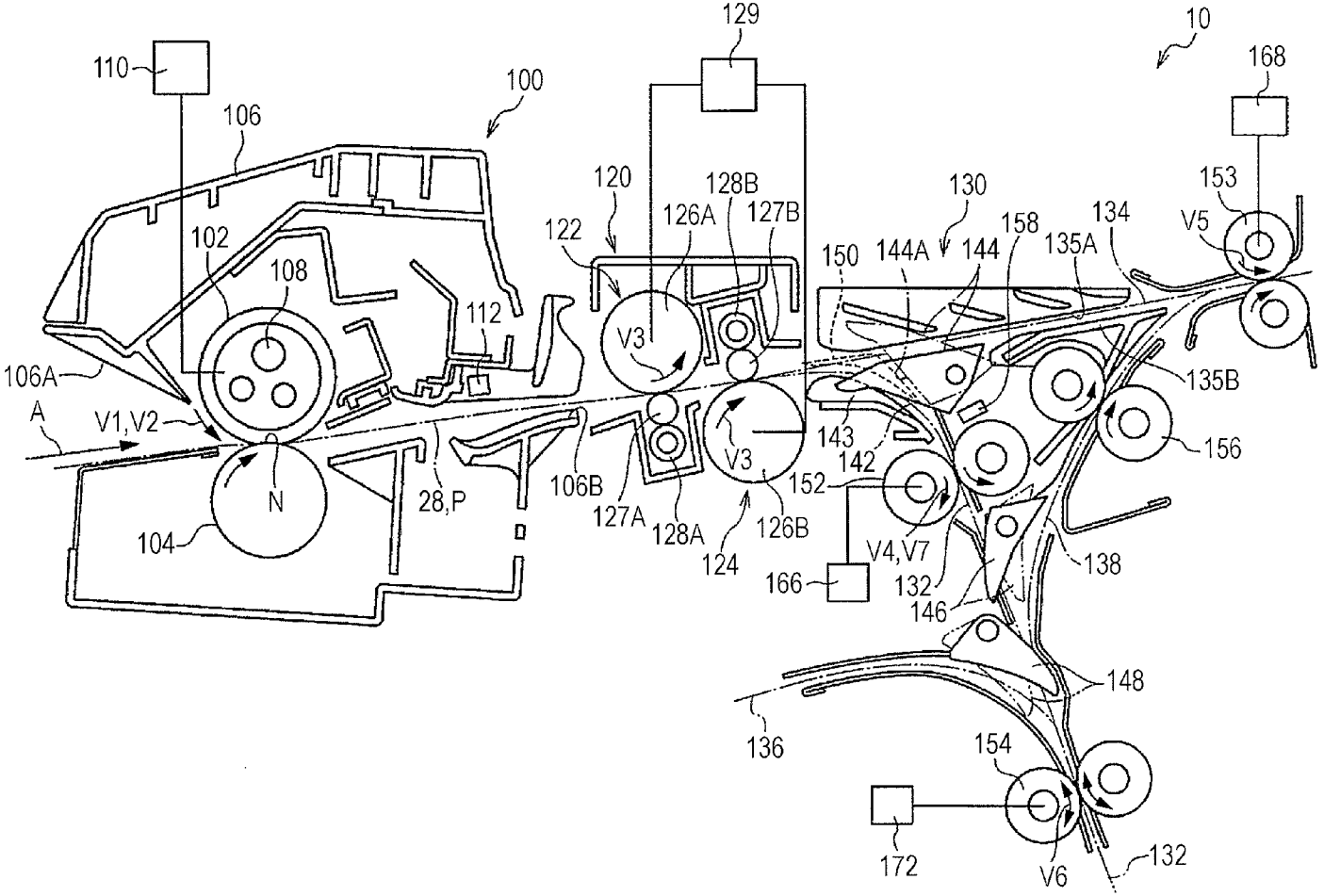
FIG. 3 shows the structure of a recording-paper transport path extending from a fixing device to a switching unit according to the exemplary embodiment of the present invention.

As shown in FIG. 3, the fixing device 100 includes a housing 106 having an opening 106A and an opening 106B. The recording paper P enters the opening 106A. The recording paper P is discharged from the opening 106B. A fixing roller 102 and a pressure roller 104 serving as an exemplary pair of first rotating members are provided as principal portions in the housing 106. The fixing roller 102 performs fixing by heating. The pressure roller 104 presses the recording paper P towards the fixing roller 102. Although the fixing device 100 is provided with, for example, temperature sensors that detect the temperatures of the pressure roller 104, the fixing roller 102, and an external heating roller that heats the fixing roller 102, these are not illustrated.

The fixing roller 102 is disposed at a toner image side (upper side) above the transport path 28 of the recording paper P. A rotary shaft of the fixing roller 102 is disposed so as to be orthogonal to the direction of transportation of the recording paper P. In an exemplary structure of the fixing roller 102, an elastic material, such as silicon rubber, covers the outer periphery of a cylindrical core formed of aluminum (not shown). A parting layer formed of fluorocarbon resin is formed around the outer peripheral surface of the elastic material. A halogen heater 108 is provided within the core. The halogen heater 108 serves as a heat source that is not in contact with the inner peripheral surface of the core. The halogen heater 108 is heated by heat generated by application of electric power from a power source (not shown), to heat the core, so that the entire fixing roller 102 is heated.

A first motor 110 that is capable of changing the peripheral velocity of the fixing roller 102 is connected to an end of the core of the fixing roller 102 through a gear (not shown). The first motor 110 is driven on the basis of a command signal sent from the controller 20 to rotationally drive the fixing roller 102 so that the peripheral velocity of the fixing roller 102 becomes a peripheral velocity V1 during ordinary fixing, and becomes a peripheral velocity V2 during fixing when the peripheral velocity is reduced for increasing the heat quantity applied to the toner images on the recording paper P.

The pressure roller 104 is disposed below the fixing roller 102 at the transport path of recording paper P. By a biasing force, such as that of a spring (not shown), the pressure roller 104 contacts and presses the outer peripheral surface of the fixing roller 102, so that a contact area (that is, a nip part N) is formed between the fixing roller 102 and the pressure roller 104. In an exemplary structure of the pressure roller 104, an elastic material, such as silicon rubber, covers the outer periphery of a cylindrical core formed of aluminum. A parting layer formed of fluorocarbon resin is formed around the outer peripheral surface of the elastic material. The pressure roller 104 is rotated by being driven by the rotation of the fixing roller 102. A halogen heater, serving as a heat source, may be provided within the core to heat the pressure roller 104.

A second sheet sensor 112 is provided above the transport path 28 in the fixing device 100. The second sheet sensor 112 detects a front end position in the transportation direction of recording paper P and a rear end position in the transportation direction of recording paper P. For the second sheet sensor 112, for example, a reflecting optical sensor that irradiates the recording paper P with light and that receives the light reflected from the recording paper P may be used. The second sheet sensor 112 is mounted at a position that is downstream from the nip part N in the direction of transportation of the recording paper P (that is, in the direction of arrow A) and that is upstream from the opening 106B in the direction of transportation of the recording paper P.

Next, the transport path 28 and the two-side transport path 136 will be described in detail.

As shown in FIG. 3, a decurl unit 120 is provided downstream from the fixing device 100 in the direction of transportation of recording paper P at the transport path 28. The decurl unit 120 straightens in the opposite direction a curl of the recording paper P after the fixing by the fixing device 100. The straightening of the curl of the recording paper P by the decurl unit 120 is performed regardless of switching between the transport paths of the recording paper P.

The decurl unit 120 includes a first decurl section 122 and a second decurl section 124. The first decurl section 122 is disposed at an upstream side in the direction of transportation of recording paper P. The second decurl section 124 is disposed at a downstream side in the direction of transportation of recording paper P. The first decurl section 122 includes a decurl roller 126A, a metallic roller 127A, and a bearing 128A. The decurl roller 126A is a sponge roller disposed at the upper side of the transport path 28. The metallic roller 127A is disposed at the lower side of the transport path 28 and contacts the outer peripheral surface of the decurl roller 126A. The bearing 128A contacts the outer peripheral surface of the metallic roller 127A at a side opposite to the decurl roller 126A, and reduces flexing of the metallic roller 127A. The outside diameter of the decurl roller 126A is larger than the outside diameter of the metallic roller 127A.

The second decurl section 124 includes a decurl roller 126B, a metallic roller 127B, and a bearing 128B. The decurl roller 126B is a sponge roller disposed at the lower side of the transport path 28. The metallic roller 127B is disposed at the upper side of the transport path 28 and contacts the outer peripheral surface of the decurl roller 126B. The bearing 128B contacts the outer peripheral surface of the metallic roller 127B at a side opposite to the decurl roller 126B, and reduces flexing of the metallic roller 127B. The outside diameter of the decurl roller 126B is larger than the outside diameter of the metallic roller 127B.

The decurl roller 126A and the decurl roller 126B, the metallic roller 127A and the metallic roller 127B, and the bearing 128A and the bearing 128B are formed of the same material and have the same shape. Directions of rotation axes of the decurl roller 126A, the decurl roller 126B, the metallic roller 127A, the metallic roller 127B, the bearing 128A, and the bearing 128B are orthogonal to the direction of transportation of recording paper P.

One second motor 129 is connected to end portions of the cores (not shown) of the decurl rollers 126A and 126B through gears (not shown). The second motor 129 is driven on the basis of a command signal sent from the controller 20 to rotationally drive the decurl rollers 126A and 126B so that the peripheral velocities of the decurl rollers 126A and 126B are a peripheral velocity V3 (≥V1). The decurl roller 126A rotates in the illustrated counterclockwise direction, whereas the decurl roller 126B rotates in the illustrated clockwise direction.

As shown in FIG. 3, a switching unit 130 is provided downstream from the decurl unit 120 in the direction of transportation of recording paper P. The switching unit 130 serving as an exemplary switching unit switches the direction of transportation of recording paper P transported along the transport path 28. At the switching unit 130, a terminal end of the transport path 28 is divided into a reverse transport path 132 and a first discharge path 134. The reverse transport path 132 serving as an exemplary first transport path has a curved portion 142 that curves downward. The first discharge path 134 serving as an exemplary second transport path is approximately a straight path extending toward the discharge unit 15 (see FIG. 1).

A portion of the reverse transport path 132 is divided into the two-side transport path 136 and a second discharge path 138. The two-side transport path 136 extends towards the transporting rollers 36 for forming an image on the back of the recording paper P. The second discharge path 138 extends towards the discharge unit 15. A guide member 143 having a curved surface forming the curved portion 142 is provided at the reverse transport path 132. A guide member 135A and a guide member 135B are provided at the first discharge path 134. The guide member 135A forms an upper wall of the first discharge path 134. The guide member 135B forms a bottom wall of the first discharge path 134 disposed opposite to the guide member 135A. For saving space in the transport path of recording paper P, the guide members 135A and 135B are disposed with a small distance therebetween, and the transport path of recording paper P is formed straight.

As shown in FIG. 1, the reverse transport path 132 is formed straight in the direction of arrow V (downward direction is indicated by −V, and upward direction is indicated by +V) from the lower right side of the body 14 to the lower right side of the sheet holding unit 12. Pairs of transporting rollers 162 that transport recording paper P are provided at the reverse transport path 132. The two-side transport path 136 is provided from a portion of the reverse transport path 132 (a third switching member 148 (described later)) towards the transporting rollers 36 in the direction H. Pairs of transporting rollers 164 that transport recording paper P are provided at the two-side transport path 136. By switching an entrance path of the rear end of the recording paper P to the two-side transport path 136 by the third switching member 148 (described below), the recording paper P that has entered the reverse transport path 132 is transported in the two-side transport path 136 in the direction of arrow B (that is, leftwards in FIG. 1). A terminal end of the two-side transport path 136 is connected to a near side of the transporting rollers 36 at the transport path 28.

As shown in FIG. 3, the switching unit 130 includes a first switching member 144, a second switching member 146, and a third switching member 148. The first switching member 144 switches the transport path of recording paper P from the transport path 28 to the reverse transport path 132 or the first discharge path 134. The second switching member 146 switches between the reverse transport path 132 and the second discharge path 138. The third switching member 148 switches between the two-side transport path 136 and the second discharge path 138. The first switching member 144, the second switching member 146, and the third switching member 148 are all triangular prismatic members. When an end of a particular switching member is moved into one particular transport path by a driving unit (not shown), the transport path of recording paper P is switched to another transport path.

The reverse transport path 132 includes a withdrawal portion 150 (see FIG. 8) serving as a space surrounded by the curved portion 142, the first discharge path 134, and a side surface 144A disposed along the reverse transport path 132 at the first switching member 144 that is switched to the side of the first discharge path 134. The size of the withdrawal portion 150 allows flexing of the recording paper P occurring as a result of differences between the peripheral velocities of the rollers (described in detail below).

A pair of first transporting rollers 152 serving as an exemplary pair of second rotating members and first transporting sections that transport sheets of recording paper P are provided at the reverse transport path 132 so as to be disposed between the first switching member 144 and the second switching member 146. A pair of second transporting rollers 154 that transport sheets of recording paper P are provided downstream from (at the illustrated lower side of) the third switching member 148. A pair of third transporting rollers 156 that transport sheets of recording paper P are provided at the second discharge path 138. A pair of discharge rollers 153 serving as an exemplary pair of third rotating members and second transporting sections that discharge sheets of recording paper P to the discharge unit 15 (see FIG. 1) are provided at a terminal end of the first discharge path 134.

A third motor 166 whose rotation is controlled (changed) by the controller 20 (see FIG. 1) rotates the first transporting rollers 152 at a peripheral velocity V4 during ordinary transportation and at a peripheral velocity V7 when the peripheral velocity is reduced. The peripheral velocity V7 is determined on the basis of the peripheral velocity V4 and the peripheral velocities V1 and V2 of the fixing roller 102.

A fourth motor 168 whose rotation is controlled by the controller 20 rotates the discharge rollers 153 at a peripheral velocity V5, so that peripheral velocity reduction is not performed. A fifth motor 172 whose rotation is controlled by the controller 20 rotates the second transporting rollers 154 at a peripheral velocity V6. Although the third transporting rollers 156 are driven by a motor (not shown), the driving will not be described.

A third sheet sensor 158 is provided between the first switching member 144 and the pair of first transporting rollers 152 outside the reverse transport path 132. The third sheet sensor 158 detects a front end position and a rear end position of recording paper P that is transported in the reverse transport path 132. For the third sheet sensor 158, for example, a reflecting optical sensor that irradiates the recording paper P with light and that receives the light reflected from the recording paper P may be used.

Figure 4:
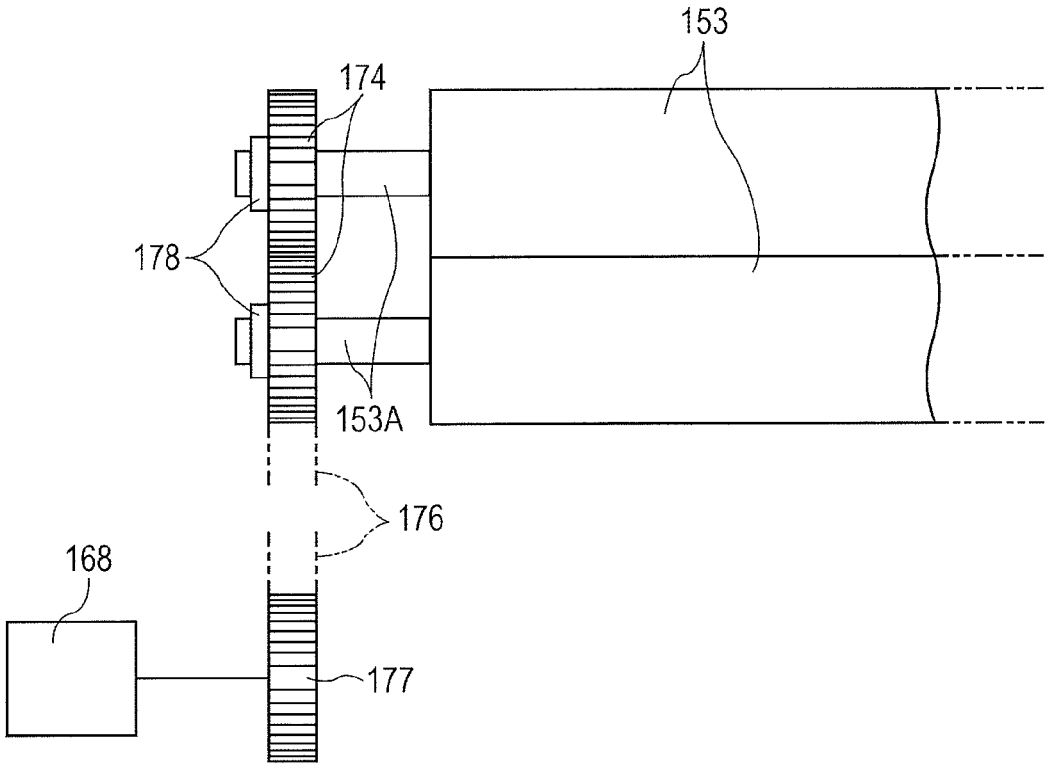
FIG. 4 illustrates a state in which torque limiters are provided at discharge rollers according to the exemplary embodiment of the present invention.

As shown in FIG. 4, a gear 174 having a preset gear ratio is secured to one end portion of a core 153A of its corresponding discharge roller 153. Driving force from a driving gear 177 of the motor 168 is transmitted to each gear 174 through a gear train 176 including multiple gears. Each gear 174 is provided with a torque limiter 178 serving as an exemplary limiting unit that limits transmission of the driving force to its corresponding discharge roller 153 when a load that is greater than or equal to a set value acts upon the corresponding discharge roller 153.

Figure 8:
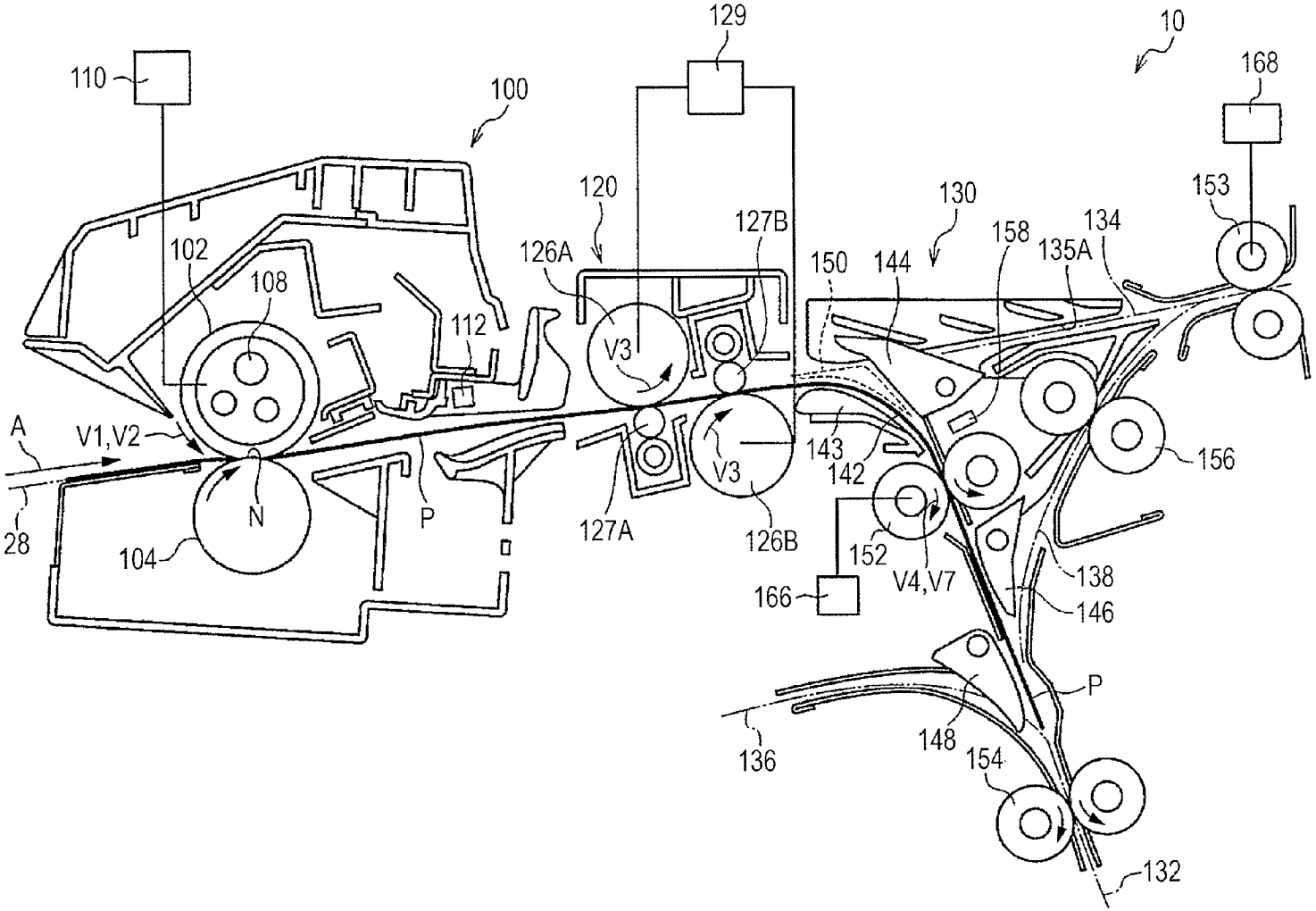
FIG. 8 illustrates a state in which recording paper is transported from the transport path to a reverse transport path according to the exemplary embodiment of the present invention.
Figure 10:
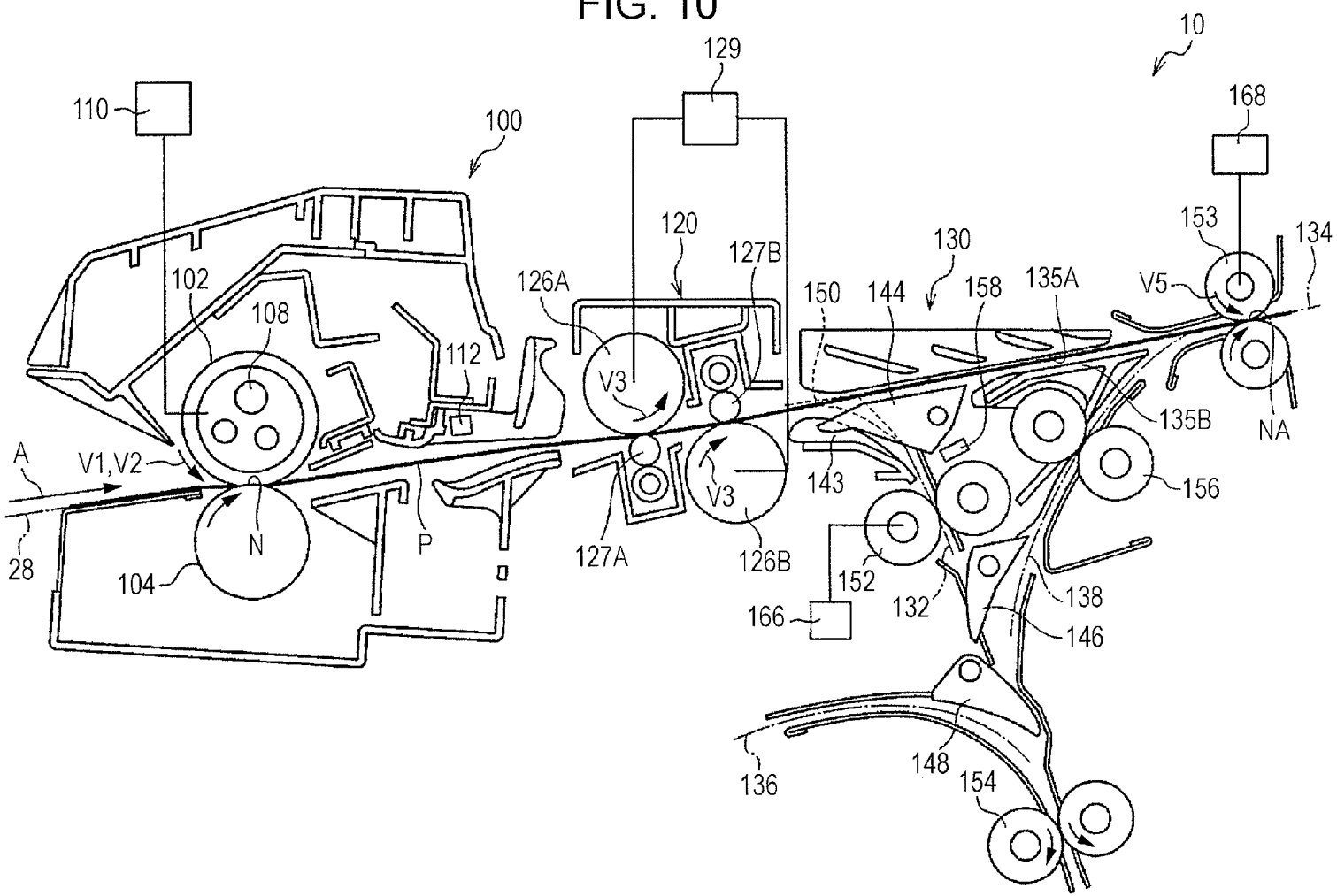
FIG. 10 illustrates a state in which the recording paper is transported from to a first discharge path from the transport path according to the exemplary embodiment of the present invention.

Here, as shown in FIG. 8, the distance from the fixing roller 102 to the first transporting rollers 152 is set smaller than the entire length of the recording paper P in the transportation direction thereof, so that a timing in which the recording paper P is nipped by both the fixing roller 102 and the first transporting rollers 152 is provided. As shown in FIG. 10, the distance from the fixing roller 102 to the discharge rollers 153 is set smaller than the entire length of the recording paper P in the transportation direction thereof, so that a timing in which the recording paper P is nipped by both the fixing roller 102 and the discharge rollers 153 is provided.

Next, the structure of each motor will be described.

Figure 5A:
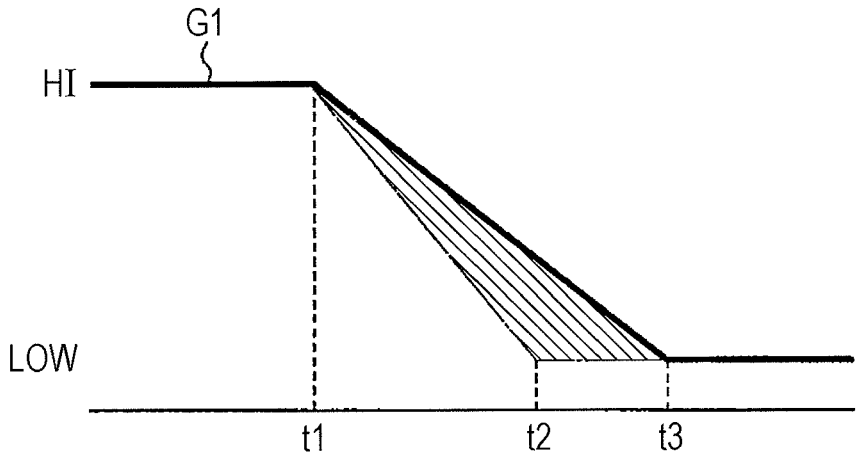
FIG. 5A is a schematic view showing velocity-reduction control of a fixing roller (DC motor) according to the exemplary embodiment of the present invention.

In FIG. 3, in the exemplary embodiment, for example, DC motors are used for the first motor 110 and the second motor 129. As shown in FIG. 5A, when the velocity of each DC motor is reduced from HI to LOW at a time t1, a timing (time) in which the velocity becomes LOW varies from a time t2 to a time t3. Therefore, the velocity may be LOW at the time t2 ($t1<t2<t3$) without becoming LOW at the time t3 ($>t1$) (solid-line graph G1). That is, when the velocity of the first motor 110 and the velocity of the second motor 129 are reduced, outputs vary in a shaded range shown in FIG. 5A.

Figure 5B:
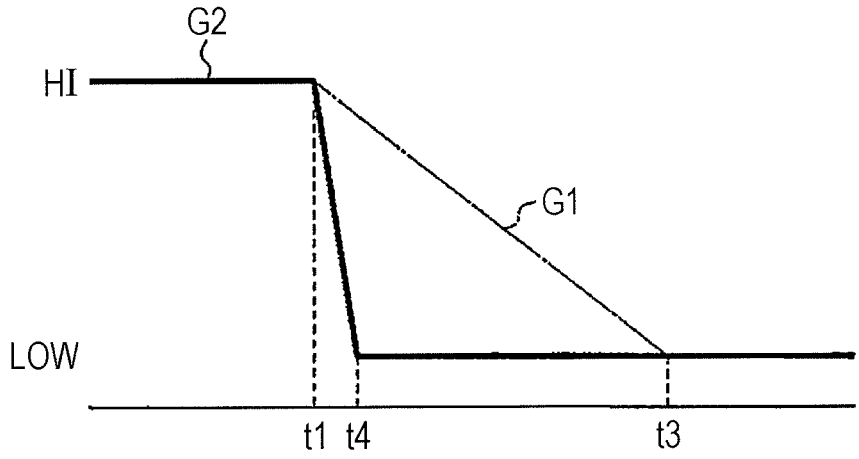
FIG. 5B is a schematic view showing velocity-reduction control of first transporting rollers (stepping motors) according to the exemplary embodiment of the present invention.

For example, stepping motors are used for the third motor 166, the fourth motor 168, and the fifth motor 172. As shown in FIG. 5B, when the velocity of each stepping motor is reduced from HI to LOW at the time t1, each output is stable compared to that of each DC motor. Therefore, the velocity becomes LOW at a time t4 ($t1<t4<t2$) (solid-line graph G2). A DC motor is used for the fixing roller 102. This is because, when a stepping motor is used, a load that is generated by pressure at the nip part N of the fixing device 100 (see FIG. 3) is large and varies considerably. Stepping motors are used for, for example, the first transporting rollers 152 and the discharge rollers 153 for ensuring stoppage precision of the recording paper P.

Figure 6:
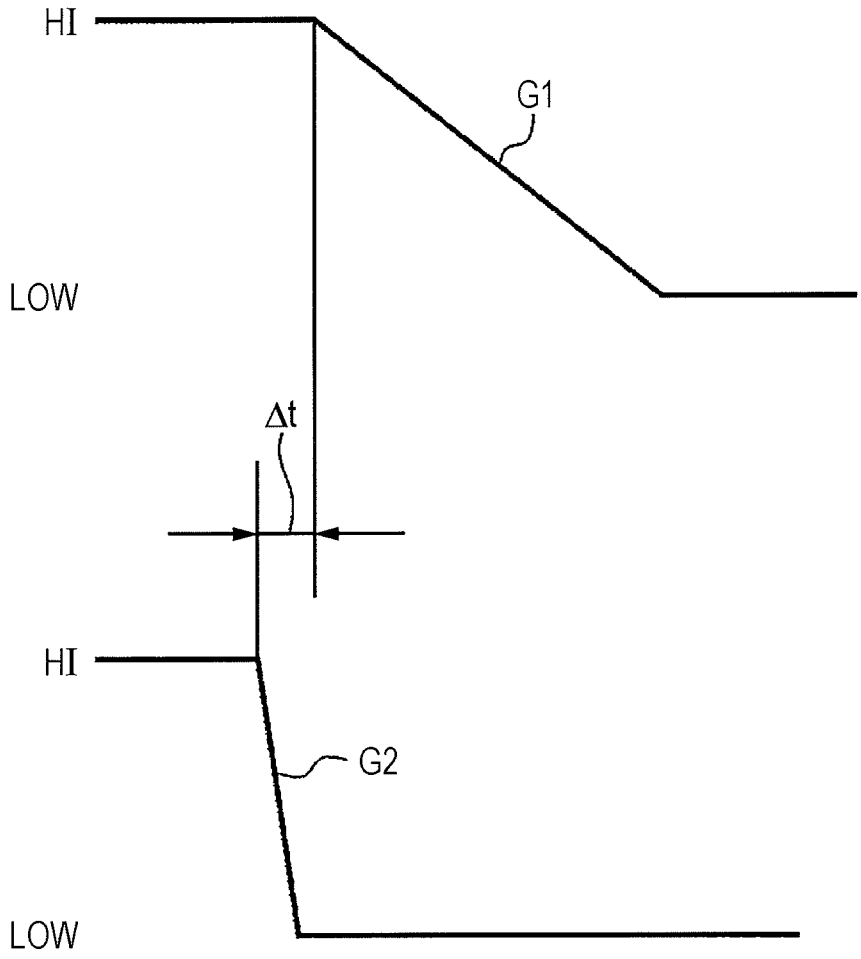
FIG. 6 is a schematic view showing velocity-reduction control of the fixing roller and the first transporting rollers according to the exemplary embodiment of the present invention.

Here, as shown in FIG. 6, in the exemplary embodiment, the controller 20 (see FIG. 1) sets a time of starting velocity reduction of the third motor 166 from HI to LOW so that it is earlier by a time Δt than a time of starting velocity reduction of the first motor 110 and velocity reduction of the second motor 129 from HI to LOW. The time Δt is set within a range that does not exceed a limit value at which a flexing amount of the recording paper P during the transportation in the reverse transport path 132 is set. Although, in the exemplary embodiment, the time of starting velocity reduction of the third motor 166 from HI to LOW is set earlier by the time Δt, Δt may be equal to 0. That is, the time of starting velocity reduction of the third motor 166 from HI to LOW may be the same as the time of starting velocity reduction of the first motor 110 and velocity reduction of the second motor 129 from HI to LOW.

Next, the setting of the peripheral velocity of each roller will be described.

Figure 7:
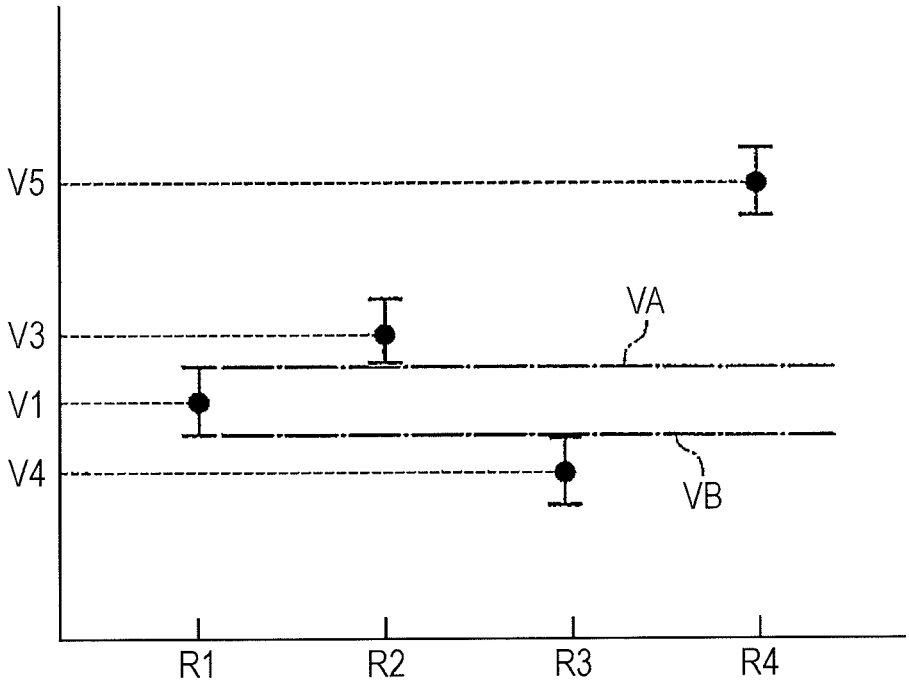
FIG. 7 is a graph that compares ordinary peripheral velocities of the fixing roller, decurl rollers, the first transporting rollers, and the discharge rollers according to the exemplary embodiment of the present invention.

FIG. 7 is a graph showing settings of the peripheral velocities of the fixing roller 102, the decurl roller 126A (126B), the first transporting rollers 152, and the discharge rollers 153 (see FIG. 3) during ordinary sheet transportation when their velocities are not reduced. A horizontal axis R1 of the graph corresponds to the fixing roller 102. A horizontal axis R2 of the graph corresponds to the decurl roller 126A (126B). A horizontal axis R3 of the graph corresponds to the first transporting rollers 152. A horizontal axis R4 of the graph corresponds to the discharge rollers 153. A central value of the setting of each peripheral velocity is shown by a black dot, and the range of variation from each central value is shown by solid lines extending upward and downward from the corresponding black dot.

With the peripheral velocity V1 of the fixing roller 102 serving as a reference, a lower limit of the peripheral velocity V3 of the decurl roller 126A (126B) is equal to or slightly larger than an upper limit of the peripheral velocity V1 (shown by an alternate long and short dash line VA in FIG. 7). An upper limit of the peripheral velocity V4 of each first transporting roller 152 is slightly less than a lower limit of the peripheral velocity V1 (shown by an alternate long and short dash line VB in FIG. 7). Further, a lower limit of the peripheral velocity V5 of the discharge rollers 153 is greater than an upper limit of the peripheral velocity V3 (that is, the peripheral velocity V1). For example, V5=1.5×V3.

When the peripheral velocity of the fixing roller 102 is reduced from the peripheral velocity V1 to the peripheral velocity V2 (<V1), the peripheral velocity of the decurl roller 126A (126B) and the peripheral velocity of the first transporting rollers 152 are set so as to be reduced by a similar proportion (ratio) while the relationship of the peripheral velocity V3 and the peripheral velocity V4 with respect to the peripheral velocity V1 is maintained.

Next, principal switching operations between the transport paths of recording paper P at the switching unit 130, and the transport paths of recording paper P will be described.

In the image forming apparatus 10 shown in FIG. 3, when transfer (including image formation) and fixing of toner images to the front surface (that is, the illustrated upper surface) of recording paper P are completed, and, then, transfer (including image formation) and fixing of toner images to the back surface (that is, the illustrated lower surface) of the recording paper P are completed, the following occurs. That is, in the switching unit 130, the first switching member 144 moves to close the first discharge path 134 and to open the reverse transport path 132; and the second switching member 146 moves to close the second discharge path 138 and to open the reverse transport path 132. Further, the third switching member 148 moves to close the two-side transport path 136, and to open the reverse transport path 132. By this, after the recording paper P transported to the transport path 28 passes the decurl unit 120, it enters the reverse transport path 132.

Next, when the rear end of the recording paper P that enters the reverse transport path 132 passes the second transporting rollers 154, the third switching member 148 closes the second discharge path 138 and opens the two-side transport path 136, and the second transporting rollers 154 rotate in the reverse direction. By this, the rear end of the recording paper P is switched to the front end, the recording paper P is transported along the two-side transport path 136, and reenters the transport path 28, so that the image formation is performed on the back surface of the recording paper P.

In the image forming apparatus 10, when the image formation is performed only on the front surface of the recording paper P, and the front and back surfaces of the recording paper P are reversed to discharge the recording paper P, the following occurs. That is, the recording paper P enters the reverse transport path 132, and the rear end thereof passes the second transporting rollers 154, at which time the second switching member 146 moves to open the second discharge path 138. When the second transporting rollers 154 rotate in the reverse direction, the rear end of the recording paper P is switched to the front end, and the recording paper P is transported to the second discharge path 138 and discharged. When the image formation and fixing are performed on the front surface of the recording paper P, and the recording paper P is discharged as it is after passing the decurl unit 120, the following occurs. That is, the first switching member 144 moves to close the reverse transport path 132, and to open the first discharge path 134.

Next, the operation according to the exemplary embodiment will be described.

In the fixing device 100 shown in FIG. 3, when recording paper P passes the nip part N, the heat quantity of the fixing roller 102 is taken away by the recording paper P, as a result of which the gloss of the rear end of the recording paper P is less than that of the front end of the recording paper P, that is, what is called uneven brightness occurs. In an exemplary method of reducing the uneven brightness, the peripheral velocity of the fixing roller 102 is reduced from V1 to V2 and the heat quantity applied to the toner images is increased. In this method, since the peripheral velocity of the fixing roller 102 is reduced from V1 to V2 after the rear end of the recording paper P moves out of the second transfer position QB (see FIG. 2), the recording paper P is nipped at the nip part N between the fixing roller 102 and the pressure roller 104, and a location between the first transporting rollers 152.

Here, differences between the operation of a first comparative example and the operation of the exemplary embodiment will be described. In the exemplary embodiment and the comparative example, as shown in FIG. 8, the front end of the recording paper P is nipped by the pair of first transporting rollers 152, the rear end of the recording paper P is nipped by the fixing roller 102 and the pressure roller 104, and the peripheral velocity of the fixing roller 102 is reduced from V1 to V2. Since the peripheral velocities of the decurl rollers 126A and 126B are reduced in synchronism with the fixing roller 102, it is assumed that the recording paper P is not pulled between the fixing roller 102 and the decurl rollers 126A and 126B.

First, the differences between the operations of the exemplary embodiment and the first comparative example when the recording paper P is transported towards the reverse transport path 132 will be described.

In the first comparative example, when the peripheral velocity of the fixing roller 102 is reduced before reducing the peripheral velocity of the first transporting rollers 152, as shown by the shaded portion shown in FIG. 5A, the peripheral velocity of the fixing roller 102 varies, so that the peripheral velocity of the first transporting rollers 152 may become higher than the peripheral velocity of the fixing roller 102. In this case, in FIG. 8, the first transporting rollers 152 whose peripheral velocity is higher than that of the fixing roller 102 pulls the recording paper P, as a result of which the back surface of the recording paper P contacts the guide member 143 at the curved portion 142. This may cause, for example, damage to the recording paper P. At a portion of the recording paper P that contacts the guide member 143, heat is taken away by the guide member 143, as a result of which glossiness may be reduced.

In contrast, in the image forming apparatus 10 according to the exemplary embodiment, first, the peripheral velocity of the first transporting rollers 152 is reduced from V4 to V7. Then, when the time Δt (see FIG. 6) elapses from a time of starting reduction in the peripheral velocity of the first transporting rollers 152, the peripheral velocity of the fixing roller 102 is reduced from V1 to V2. By this, even if the peripheral velocity of the fixing roller 102 varies, the peripheral velocity of the first transporting rollers 152 is infrequently made higher than the peripheral velocity of the fixing roller 102. As a result, the recording paper P is no longer pulled by the fixing roller 102 and the first transporting rollers 152 (that is, from both sides of the curved portion 142). Therefore, the recording paper P is infrequently pushed against the guide member 143 (an inner peripheral side of the curved portion 142).

Figure 9A:
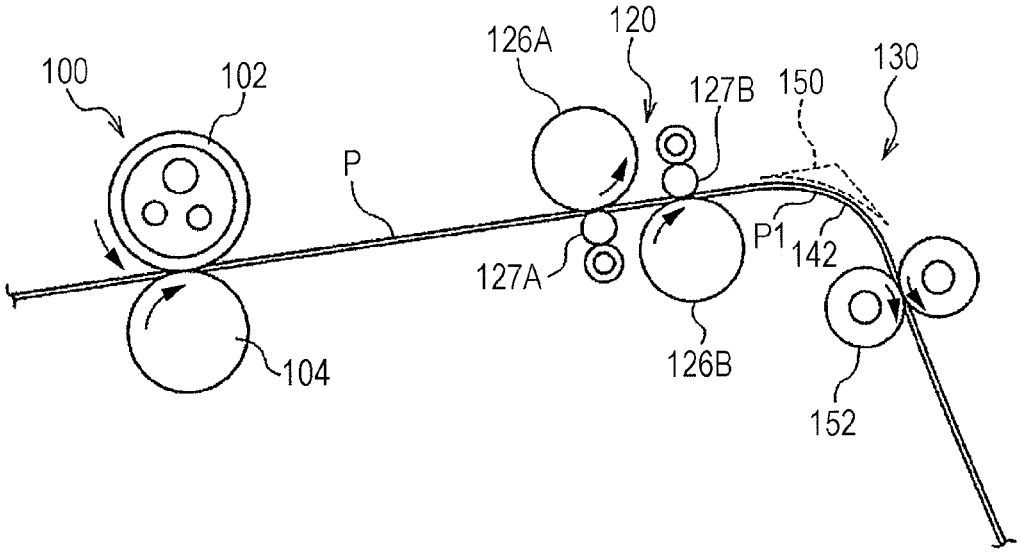
FIG. 9A is a schematic view showing the shape of the recording paper when the fixing roller, the decurl rollers, and the first transporting rollers are rotating at the ordinary peripheral velocities according to the exemplary embodiment of the present invention.
Figure 9B:
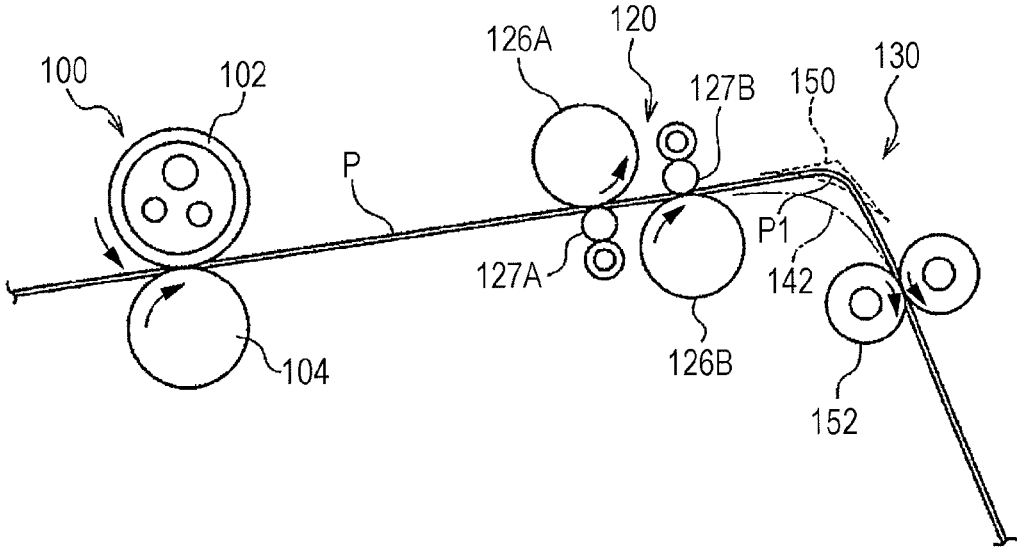
FIG. 9B is a schematic view showing the shape of the recording paper when the ordinary peripheral velocities of the fixing roller, the decurl rollers, and the first transporting rollers are reduced according to the exemplary embodiment of the present invention.

In the image forming apparatus 10 according to the exemplary embodiment, in a transportation state of recording paper P shown in FIG. 9A, since the peripheral velocity of the second transporting rollers 152 is lower than the peripheral velocity of the fixing roller 102, a flexing amount of a flexing portion P1 of the recording paper P at the curved portion 142 may increase. However, as shown in FIG. 9B, since the flexing of the flexing portion P1 is allowed by the withdrawal portion 150, it is possible to suppress, for example, buckling of the recording paper P compared to that in a structure that does not include the withdrawal portion 150.

Next, differences between the operation of the exemplary embodiment and the operation of a second comparative example when the recording paper P is transported to the first discharge path 134 will be described.

In the image forming apparatus 10 shown in FIG. 10, in a structure in which the peripheral velocity V5 of the discharge rollers 153 is lower than the peripheral velocity V2 of the fixing roller 102, since the first discharge path 134 is a straight path having a narrow vertical interval, the recording paper P is flexed, and contacts the guide members 135A and 135B. This may damage an image on the recording paper P. Therefore, the peripheral velocity V5 of the discharge rollers 153 is higher than the peripheral velocity V2 of the fixing roller 102.

However, since the peripheral velocity V5 of the discharge rollers 153 does not change, when the peripheral velocity of the fixing roller 102 is reduced from V1 to V2, the difference between the peripheral velocity of the discharge rollers 153 and the peripheral velocity of the fixing roller 102 becomes large. Therefore, as described above, each gear 174 (see FIG. 4) of the corresponding discharge roller 153 is provided with the corresponding torque limiter 178 (see FIG. 4).

Here, in the second comparative example, in a structure in which the peripheral velocity V5 of the discharge rollers 153 is higher than the peripheral velocity V2 of the fixing roller 102 and in which the gears 174 (see FIG. 4) of the discharge rollers 153 are not provided torque limiters 178 (see FIG. 4), the recording paper P is excessively pulled between the discharge rollers 153 and the fixing roller 102 and between the discharge rollers 153 and the pressure roller 104. This is because the peripheral velocity V5 of the discharge rollers 153 is higher than the peripheral velocity V2 of the fixing roller 102, and because pressure acting upon the recording paper P at the nip part N between the fixing roller 102 and the pressure roller 104 is higher than pressure acting upon the recording paper P at a nip part NA between the pair of discharge rollers 153.

In contrast, in the image forming apparatus 10 according to the exemplary embodiment, since the gears 174 (see FIG. 4) of the discharge rollers 153 are provided with the torque limiters 178 (see FIG. 4), the recording paper P is in a pulled state between the discharge rollers 153 and the fixing roller 102 and between the discharge rollers 153 and the pressure roller 104. When a load that is equal to or greater than a set value acts upon the discharge rollers 153, the torque limiters 178 limit the transmission of driving force from the fourth motor 168 to the discharge rollers 153, so that the pulling of the recording paper P is suppressed (absorbed). Then, the recording paper P is transported so as to follow the peripheral velocity V2 of the fixing roller 102.

The present invention is not limited to the above-described exemplary embodiment.

The fixing roller 102 may be a fixing belt that is heated by an electromagnetic induction method. In addition, the time of starting reduction of the peripheral velocity of the fixing roller 102 and the time of starting reduction of the peripheral velocity of the first transporting rollers 152 may be the same.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a fixing device including a pair of first rotating members, the fixing device fixing an image to a recording medium by interposing the recording medium on which the image is formed between the pair of first rotating members, a peripheral velocity of the pair of first rotating members being variable, and the pair of first rotating members comprising a fixing roller that fixes the image by heating;

a first transport path having a curved portion where the recording medium is curved, the first transport path being for transporting the recording medium to which the image is fixed by the pair of first rotating members;

a first transporting section including a pair of second rotating members provided downstream from the curved portion of the first transport path, the first transporting section transporting the recording medium downstream by interposing the recording medium between the pair of second rotating members, a peripheral velocity of the pair of second rotating members being variable; and a controller that controls so that, while the recording medium is interposed between the pair of first rotating members and interposed between the pair of second rotating members, the peripheral velocity of the second rotating members and the peripheral velocity of the first rotating members are reduced at the same time, or the peripheral velocity of the second rotating members is reduced before reducing the peripheral velocity of the first rotating members.

2. The image forming apparatus according to claim 1, further comprising a second transport path whose curvature is less than curvature of the first transport path, the second transport path being for transporting the recording medium to which the image is fixed by the pair of first rotating members;

a switching unit that switches a route for transportation of the recording medium between the first transport path and the second transport path;

a second transporting section including a pair of third rotating members provided at the second transport path, the second transporting section transporting the recording medium that is interposed between the pair of third rotating members to a downstream side of the second transport path by rotationally driving the pair of third rotating members so that a peripheral velocity of the pair of third rotating members is higher than the peripheral velocity of the pair of first rotating members; and a limiting unit provided at the second transporting section, the limiting unit limiting transmission of driving force to the third rotating members when a load that is greater than or equal to a set value acts upon the third rotating members.

3. The image forming apparatus according to claim 2, wherein the first transport path has a space at the curved portion, the space allowing flexing of the recording medium as a result of a difference between the peripheral velocity of the first rotating members and the peripheral velocity of the second rotating members.

4. The image forming apparatus according to claim 1, wherein the first transport path has a space at the curved portion, the space allowing flexing of the recording medium as a result of a difference between the peripheral velocity of the first rotating members and the peripheral velocity of the second rotating members.

5. The image forming apparatus according to claim 1, wherein an amount of time to reduce the peripheral velocity of the first rotating members is greater than an amount of time to reduce the peripheral velocity of the second rotating members.

6. The image forming apparatus according to claim 1, wherein the peripheral velocity of the first rotating members is controlled by a first motor, the peripheral velocity of the second rotating members is controlled by a second motor, and a type of the first motor is different from a type of the second motor.

7. The image forming apparatus according to claim 1, wherein the first motor is a direct current DC motor and the second motor is a stepping motor.

8. The image forming apparatus according to claim 1, wherein the peripheral velocity of the second rotating members is less than the peripheral velocity of the first rotating members before the peripheral velocity of the second rotating members and the peripheral velocity of the first rotating members are reduced.

9. The image forming apparatus according to claim 1, wherein an amount of time to reduce the peripheral velocity of the first rotating members varies.

10. The image forming apparatus according to claim 1, wherein the controller sets the peripheral velocity of the second rotating members and the peripheral velocity of the first rotating members so as to be reduced by a similar proportion while the relationship of each other is maintained.

11. The image forming apparatus according to claim 10, further comprising a second transport path whose curvature is less than curvature of the first transport path, the second transport path being for transporting the recording medium to which the image is fixed by the pair of first rotating members;

a switching unit that switches a route for transportation of the recording medium between the first transport path and the second transport path;

a second transporting section including a pair of third rotating members provided at the second transport path, the second transporting section transporting the recording medium that is interposed between the pair of third rotating members to a downstream side of the second transport path by rotationally driving the pair of third rotating members so that a peripheral velocity of the pair of third rotating members is higher than the peripheral velocity of the pair of first rotating members;

and a limiting unit provided at the second transporting section, the limiting unit limiting transmission of driving force to the third rotating members when a load that is greater than or equal to a set value acts upon the third rotating members.

12. The image forming apparatus according to claim 10, wherein the first transport path has a space at the curved portion, the space allowing flexing of the recording medium as a result of a difference between the peripheral velocity of the first rotating members and the peripheral velocity of the second rotating members.

13. An image forming apparatus comprising:

a fixing device including a pair of first rotating members to fix an image to a recording medium by interposing the recording medium on which the image is formed between the pair of first rotating members, a peripheral velocity of the pair of first rotating members being variable, and the pair of first rotating members comprising a fixing roller that fixes the image by heating;

a first transporting section including a pair of second rotating members provided downstream from the fixing device, the first transporting section transporting the recording medium downstream by interposing the recording medium between the pair of second rotating members, a peripheral velocity of the pair of second rotating members being variable; and a controller that controls so that, while the recording medium is interposed between the pair of first rotating members and interposed between the pair of second rotating members, the peripheral velocity of the second rotating members and the peripheral velocity of the first rotating members are reduced at the same time, or the peripheral velocity of the second rotating members is reduced before reducing the peripheral velocity of the first rotating members.

14. The image of forming apparatus according to claim 13, wherein an amount of time to reduce the peripheral velocity of the first rotating members is greater than an amount of time to reduce the peripheral velocity of the second rotating members.

15. An image forming apparatus comprising:

a fixing device including a pair of first rotating members, the fixing device fixing an image to a recording medium by interposing the recording medium on which the image is formed between the pair of first rotating members, a peripheral velocity of the pair of first rotating members being variable, and the pair of first rotating members comprising a fixing roller that fixes the image by heating;

a first transport path having a curved portion where the recording medium is curved, the first transport path being for transporting the recording medium to which the image is fixed by the pair of first rotating members;

a first transporting section including a pair of second rotating members provided downstream from the curved portion of the first transport path, the first transporting section transporting the recording medium downstream by interposing the recording medium between the pair of second rotating members, a peripheral velocity of the pair of second rotating members being variable;

and a controller that controls so that, while the recording medium is interposed between the pair of first rotating members and interposed between the pair of second rotating members, the peripheral velocity of the second rotating members is reduced before reducing the peripheral velocity of the first rotating members.

16. The image forming apparatus according to claim 15, wherein the first transport path has a space at the curved portion, the space allowing flexing of the recording medium as a result of a difference between the peripheral velocity of the first rotating members and the peripheral velocity of the second rotating members.

* * * * *